US006948866B2

(12) United States Patent
Okochi

(10) Patent No.: US 6,948,866 B2
(45) Date of Patent: Sep. 27, 2005

(54) PRINTING DEVICE

(75) Inventor: Satoshi Okochi, Iwatsuki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/628,392

(22) Filed: Jul. 29, 2003

(65) Prior Publication Data

US 2004/0120747 A1 Jun. 24, 2004

(30) Foreign Application Priority Data

Dec. 19, 2002 (JP) ..... 2002-368199

(51) Int. Cl.[7] ..... B41J 11/44

(52) U.S. Cl. ..... 400/76; 400/62; 400/63; 358/1.15

(58) Field of Search ..... 400/76, 70, 71, 400/61–63; 358/1.9, 1.5

(56) References Cited

U.S. PATENT DOCUMENTS 5,822,534 A * 10/1998 Yamunachari et al. ..... 709/224
2002/0140966 A1 * 10/2002 Meade et al. ..... 358/1.15
2003/0033451 A1 * 2/2003 Yoshida et al. ..... 710/8
2003/0217124 A1 * 11/2003 Parry ..... 709/220
2003/0229691 A1 * 12/2003 Ishimoto ..... 709/223

FOREIGN PATENT DOCUMENTS

JP A 6-320845 11/1994
JP 07256948 A * 10/1995 ..... B41J/5/30

* cited by examiner

*Primary Examiner*—Minh Chau
(74) *Attorney, Agent, or Firm*—Oliff & Berridge, PLC

(57) ABSTRACT

The present invention provides a printing device, which notifies an administrator of access to its setting information. A control circuit in the printing device determines whether notification of changes made to the settings should be sent to the administrator based on preset notifications prerecorded in the printing device. When it is determined that the administrator should be notified, the printing device sends information on the changed settings via a communication circuit to an administrator terminal, which has been prerecorded in a storage device.

18 Claims, 4 Drawing Sheets

PRINTING DEVICE

CROSS-REFERENCE TO RELATED APPLICATION

This application claims priority under 35 USC 119 from Japanese Patent Application No. 2002-368199, the disclosure of which is incorporated by reference herein.

BACKGROUND OF THE INVENTION

1. Field of the Invention

The present invention relates to a printing device and, more particularly, to a printing device, which sends notification of its status.

2. Description of the Related Art

In many of today's offices, personal computers are connected to a network and to peripheral devices such as printers, which are shared by multiple computers through the network. In such a networked environment, it is often difficult for a user, including an administrator such as a system manager, to know the status of the peripheral device at any given time, because the user is not necessarily near the peripheral device at all times.

In order to solve the above-described problem, a printer that allows the user to assess the status of the printer, even when the user is not physically next to the printer itself, has been proposed. This printer notifies the user of errors, such as when the printer cover is open or when the printer is jammed, by sending a message to the user via e-mail or the like (see: JP-A No. 6-320845).

However, when a user other than the system manager changes the settings on the printer, either deliberately or unintentionally, the system manager is not notified of the changes. When the changes are the source of system trouble, the system manager must first surmise that a user has changed the settings, and then based on the current settings, speculate what kind of changes were made thereto. Accordingly, solving such problems requires a lot of experience and man-hours.

SUMMARY OP THE INVENTION

The present invention has been made, considering the above circumstances, and the object is to provide a printing device by which access to setting information is notified to an administrator.

In order to achieve the above object, a first aspect of the invention is to provide a printing device connected to a network, the printing device comprising: an inputting component which inputs access requirements to setting information which has been set in the printing device; and a notification component for sending notification of inputted access requirement information to a predetermined terminal for an administrator, which has been assigned in the printing device in advance.

That is, the printing device has a configuration in which requirement for access to the setting information which has been set in the printing device is input by the inputting component of the printing device, and inputted access requirement information is notified by the notification component to the predetermined terminal, which has been assigned in the printing device in advance, for the administrator. Accordingly, the administrator can easily find that the requirement for access to the setting information in the printing device has been executed.

The printing device according to the first aspect of the invention may have a configuration further comprising an access component by which the setting information is accessed, based on the information on the access requirement, wherein information on access to the setting information may be notified by the notification component to the terminal for the administrator when the setting information is accessed by the access component.

That is, the printing device has a configuration in which setting information is accessed by the access component of the printing device, based on the information on access requirement, and information on access to the setting information is notified by the notification component to the terminal for the administrator when the setting information is accessed by the access component. Accordingly, the administrator can easily find that the setting information in the printing device has been accessed.

The printing device according to the first aspect of the invention may have a configuration further comprising a determination component by which it is determined whether the information on the access requirement is predetermined information or not, wherein notification of the information on the access requirement, which has been determined by the determination component to be the predetermined information, is sent by the notification component.

That is, the printing device has a configuration in which it is determined by the determination component of the printing device whether the information on the access requirement is the predetermined information or not and the information on the access requirement, which has been determined by the determination component to be the predetermined information is notified by the notification component. Accordingly, an administrator can easily find that the predetermined setting information in the printing device has been accessed.

The printing device according to the first aspect of the invention may have a configuration further comprising an information changing component by which the predetermined information is changed.

That is, an administrator can change the predetermined information in the printing device, with which the administrator can easily find to have been accessed, because the information changing component in the printing device is configured to change the predetermined Betting information.

The notification component in the printing device according to the first aspect of the invention may be e-mail.

The notification component in the printing device according to the first aspect of the invention may be an MIB (Management Information Base).

In the printing device according to the first aspect, the setting information may be on at least one of a setting for networking and that for printing conditions.

In the printing device according to the first aspect of the invention, the access to the setting information may be for at least one of changing of the setting information and referring to the setting information.

A second aspect of the invention is to provide a printing device connected to a network, the printing device comprising: an inputting component by which requirement for access to setting information which has been set in the printing device is input; and a recording component by which inputted access requirement information is recorded.

That is, the printing device has a configuration in which requirement for access to the setting information which has been set in the printing device is input by the inputting component of the printing device and the inputted access requirement information is recorded by the recording component. Accordingly, the user can easily find that the requirement for access to the setting information in the printing device has been executed.

The printing device according to the second aspect of the invention may have a configuration further comprising an access component by which the setting information is accessed, based on the information on the access requirement, wherein the information on access to the setting information is recorded by the recording component when the setting information has been accessed by the access component.

That is, the setting information is accessed, based on the information on the access requirement by the access component and the information on access to the setting information is recorded by the recording component when the setting information has been accessed by the access component. Accordingly, the user can easily find that the setting information in the printing device has been accessed.

The printing device according to the second aspect of the invention may have a configuration further comprising a determination component by which it is determined whether the information on the access requirement is the predetermined information or not, wherein the information on the access requirement, which has been determined by the determination component to be the predetermined information is recorded by the recording component.

The printing device is configured such that the determination component determines whether access requirement information is the predetermined information and the access requirement information, which has been determined by the determination component to be the predetermined information, is recorded by the recording component. Accordingly, the user can easily find that the predetermined setting information in the printing device has been accessed.

The printing device according to the second aspect of the invention may have a configuration further comprising an information changing component by which the predetermined information is changed.

That is, the predetermined information is configured to be changed by the information changing component in the printing device. Accordingly, the user can change the predetermined setting information in the printing device, with which the user can easily find to have been accessed.

The printing device according to the second aspect of the invention may have a configuration further comprising a display component on which the information on the access requirement, which has been recorded by the recording component is displayed.

The printing device according to the second aspect of the invention may have a configuration further comprising a notification component by which the information on the access requirement, which is to be recorded by the recording component, is notified to a terminal for an administrator, which has been assigned in the printing device in advance.

In the printing device according to the second aspect of the invention, the setting information may be at least one of a setting for network and that for printing conditions.

In the printing device according to the second aspect of the invention, the access to the setting information may be at least one of changing of the setting information and referring to the setting information.

A third aspect of the invention is to provide a method by which information on requirement for access to a printing device connected to a network is notified, the method comprising the steps of: inputting requirement for access to setting information which has been set in the printing device; and notifying inputted access requirement information to a predetermined terminal for an administrator, which has been assigned in the printing device.

A fourth aspect of the invention is to provide a method by which information on requirement for access to a printing device connected to a network is recorded, the method comprising the steps of: inputting requirement for access to setting information which has been set in the printing device; and recording inputted access requirement information.

As explained above, the printing device according to the invention has a configuration in which requirement for access to setting information which has been set in the printing device is input by an inputting component, and inputted access requirement information is notified by a notification component to a predetermined terminal for an administrator, which has been assigned in the printing device in advance. Accordingly, the administrator can easily find that the requirement for access to the setting information in the printing device has been executed.

DETAILED DESCRIPTION OF THE INVENTION

Hereinafter, a first embodiment according to the present invention will be explained, referring to drawings.

Figure 1:
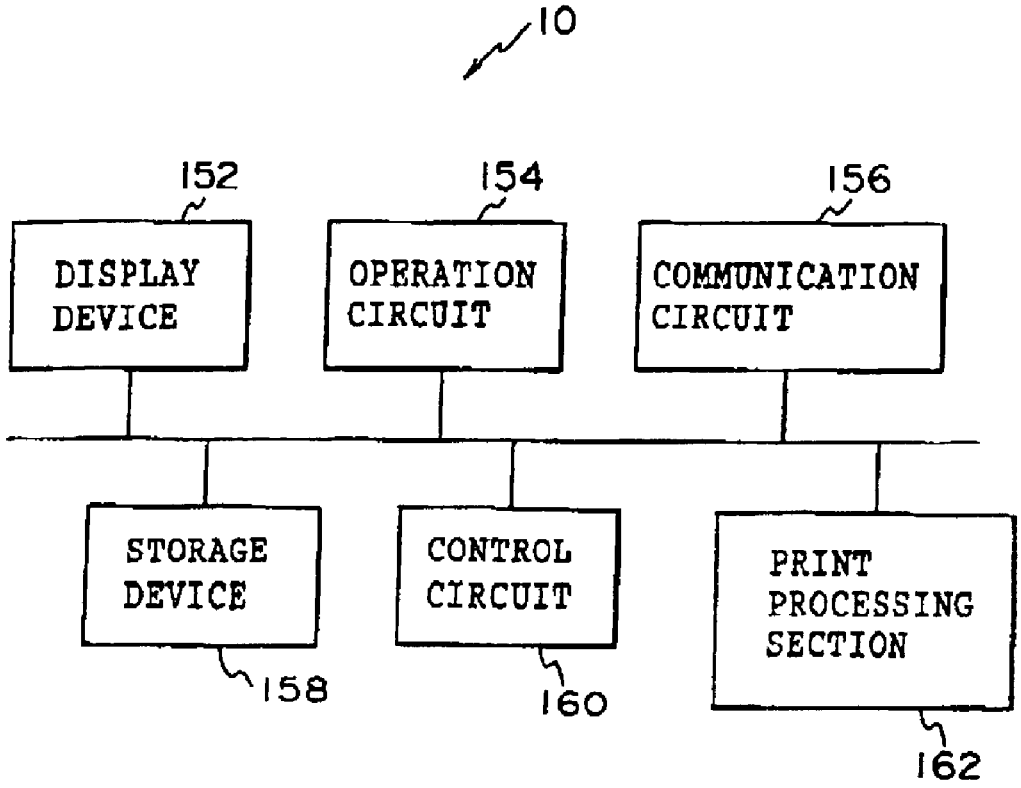
FIG. 1 shows a configuration of a printing device of an embodiment of the present invention.

As shown in FIG. 1, a printing device 10 according to the first embodiment comprises a display device 152, such as an LCD, which functions as a display component; an operation circuit 154, which has keys, buttons and the like and functions as an inputting component that is operated by selecting a menu item displayed on the display device 152, in order to refer to and change settings in the printing device 10; a communication circuit 156, which is connected to a network and functions as a notifying component for communicating with external devices such as an administrator terminal; a storage device 158, which acts as a recording component, in which the settings and the like are recorded; a control circuit 160, which is connected to the display device 152, the operation circuit 154, the communication circuit 156 and the storage device 158 through a bus and controls them by functioning as an access component and a determination component; and a print processing section 162, which executes print processing. An information changing component comprises the operation circuit 154, the storage device 158, and the control circuit 160.

Next, the operation of the first embodiment will be explained, while referring to FIG. 2.

Figure 2:
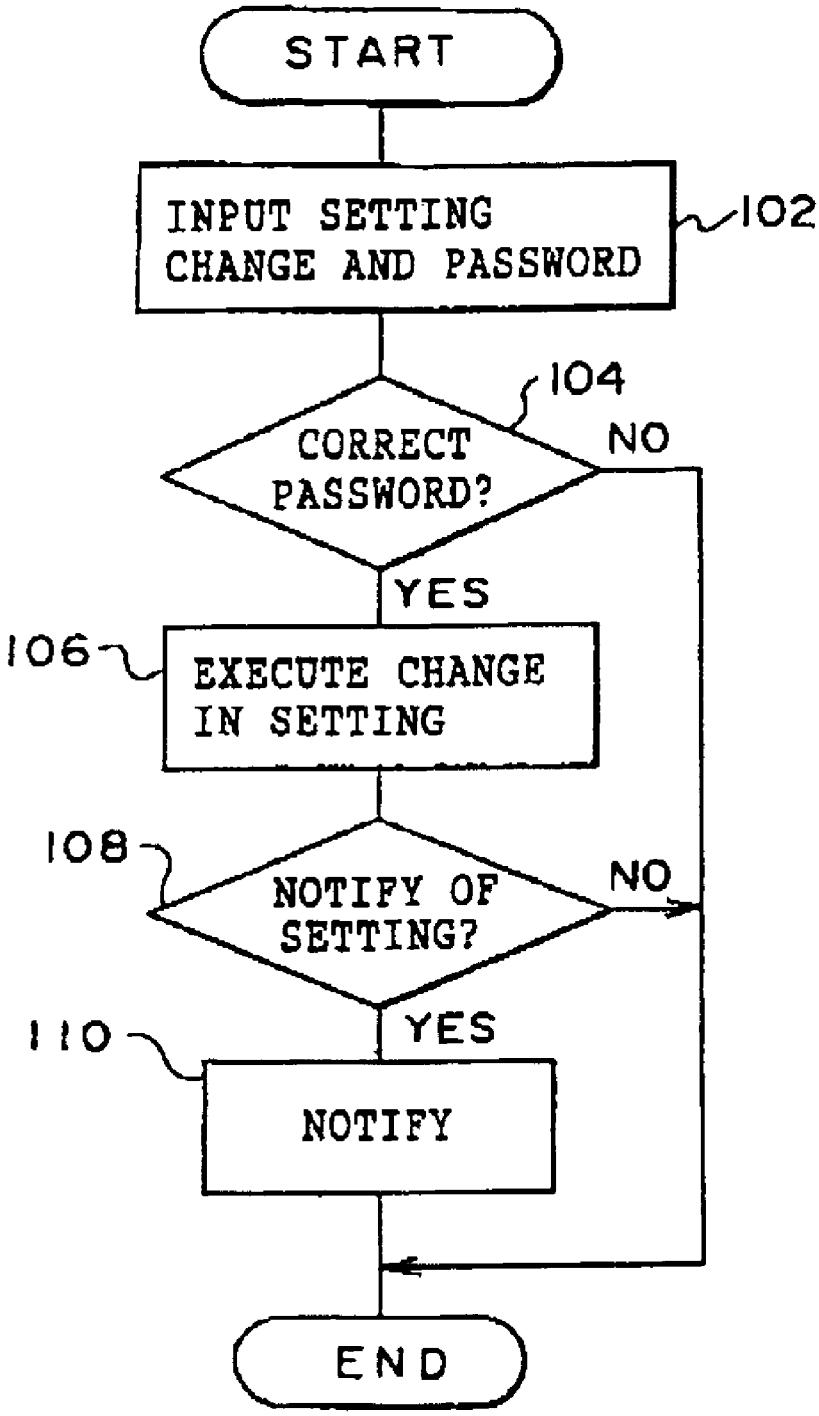
FIG. 2 is a flow chart showing the operation of a first embodiment of the invention.

The user operates the operation circuit 154 in the printing device 10, and a change setting screen is displayed on the display device 152 to start the processing in FIG. 2. At STEP 102, in accordance with instructions displayed on the change setting screen, the user inputs setting changes and a password by operating the operation circuit 154 of the printing device 10. At STEP 104, the inputted password is transmitted to the control circuit 160 and, if it is determined that the inputted password is right for changing the settings to the inputting settings, the settings are changed by the control circuit 160 at STEP 106 by recording the settings to be changed in the storage device 158.

At STEP 108, the control circuit 160 determines whether the administrator needs to be notified of changes to the settings based on notification-necessary settings that have been prerecorded in the storage device 158. When it has been determined that notification of the changes to the setting should be sent, the changed setting data is transmitted at STEP 110 via the communication circuit 156 to the administrator terminal, which has an address prerecorded in the storage device 158, and the processing is terminated.

Processing is terminated when the password entered at STEP 104 is determined to be incorrect, and when it is determined that the administrator does not need to be notified of the changed setting.

In other words, the printing device 10 is configured to send setting changes to a predetermined administrator terminal, hence, the administrator can easily know of setting changes made in the printing device 10.

Therefore, when the administrator encounters trouble in the printing device 10, the trouble can be dealt with by referring to the notification of the setting data sent to the administrator terminal. This reduces the time the administrator has to spend solving the problem, and eliminates the need for an experienced administrator who can, based on that experience, surmise the source of the trouble.

The following items are listed as changeable settings: for example, a setting for a network connection such as an IP (Internet Protocol) address; a setting for printing conditions such as the size of printing paper and a type of an ink color; and a setting for printing on a piece of special printing paper. Certain settings, when changed, can cause fatal errors to occur. This is especially true in cases where the IP address is erroneously changed and the printing device 10 is no longer recognized by the network, making printing impossible.

The terminal for the administrator may be a server or a client for the administrator, a PDA (personal digital assistant), a cellular telephone and the like. Notification at STEP 110 may be transmitted, for example, by e-mail or may be an MIB (Management Information Base). Moreover, a control signal, which controls the terminal for the administrator according to the characteristic thereof, for example, by which a specific sound is output from the terminal for the administrator and by which the terminal for the administrator is vibrated, may be transmitted.

Furthermore, when the setting is changed, it has been determined at STEP 108 in the embodiment whether the changed setting is required to be notified or not. But the invention is not limited to the above embodiment. For example, at STEP 102, at which requirement for change of the setting is input, that is, at which the setting is required to be changed, it may be determined, as executed at STEP 108, whether the setting is required to be notified or not, and the setting may be notified when it is determined that the setting is required to be notified.

Though, when the setting is changed, it has been determined at STEP 108 in the embodiment whether the setting is required to be notified or not, the invention is not limited to the above embodiment. When the setting is accessed, for example, when the setting is required to be referred to, or when referring to the setting is executed, it may be determined as executed at STEP 108 whether the setting is required to be notified or not, and the setting may be notified when it is determined that the setting is required to be notified.

Though input of requirement for change of a setting and a password has been configured to be executed through the operation circuit 154 in the printing device 10 at STEP 102 in the embodiment, the invention is not limited to the above embodiment. For example, the input may be executed through a personal computer connected to the printing device 10 through the network.

Figure 3:
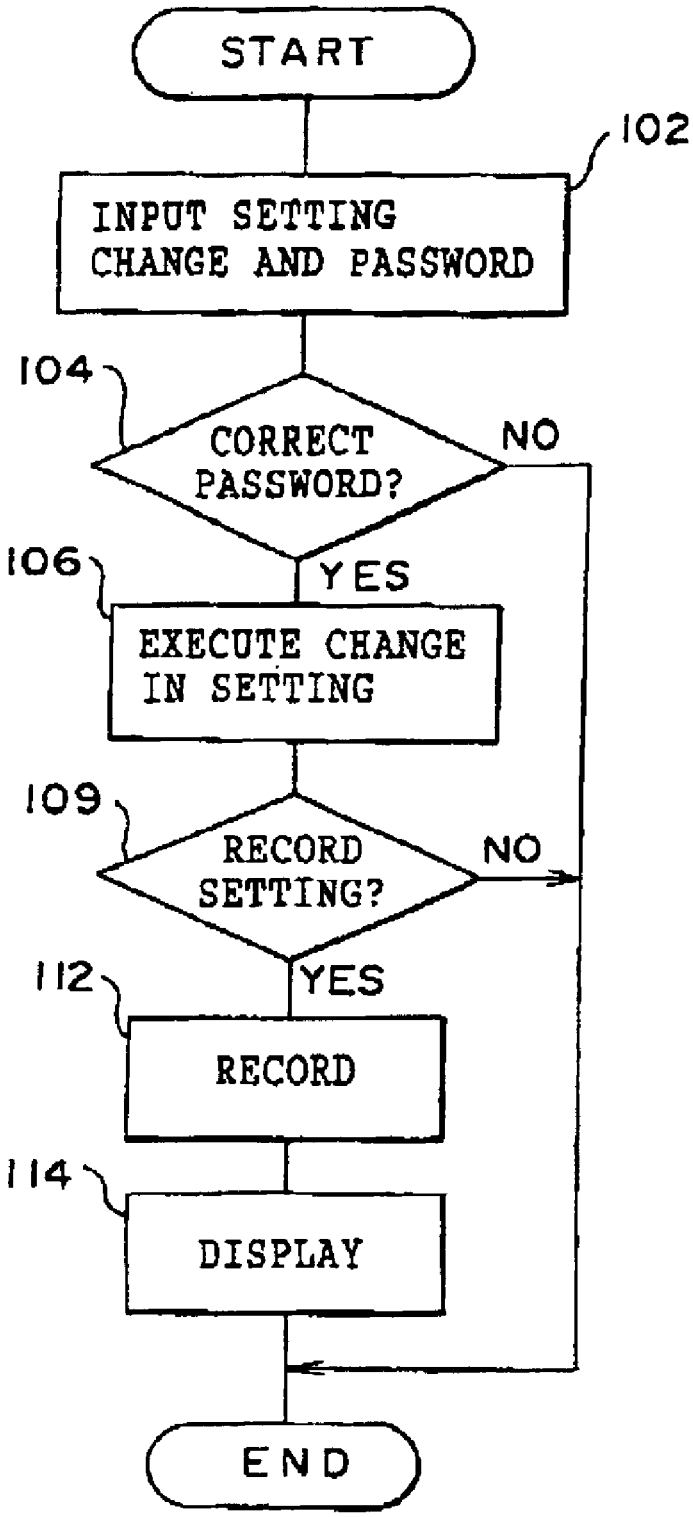
FIG. 3 is a flow chart showing the operation of a second embodiment of the invention.

Next, the operation of a second embodiment will be explained while referring to FIG. 3. Since the configuration of the second embodiment is similar to that of the first embodiment, the explanation regarding the same will be omitted. Moreover, with regard to the operation, components similar to those previously described in the first embodiment are denoted by the same reference numbers as those in FIG. 2, and the explanation will be eliminated.

When a setting is changed at STEP 106, it is determined at STEP 109 in a control circuit 160, based on settings, which are required to be recorded and have been recorded in a storage device 158 in advance, whether the changed setting is required to be recorded in the storage device 158 or not. When it is determined that the changed setting is required to be recorded, information on the changed setting is recorded in the storage device 158 at STEP 112 and the information on the changed setting is displayed on a display device 152 at STEP 114.

That is, the user can easily find that the setting in a printing device 10 has been changed because the information on the changed setting is configured to be recorded in the storage device 158 of the printing device 10.

Therefore, when the user including an administrator finds any troubles in the printing device 10, the troubles can be eliminated, referring to the information on the settings which have been recorded in the storage device 158. Thereby, the labor, which the user is required to spend for eliminating the troubles, is reduced. Moreover, the user will not be required to have experience-base knowledge, which is necessary for supposing the causes of the troubles.

Furthermore, when the setting is executed, it has been determined at STEP 109 in the embodiment whether the changed setting is required to be recorded or not. But the invention is not limited to the above embodiment. For example, at STEP 102 at which requirement for change of the setting is input, that is, at which the setting is required to be changed, it may be determined, as executed at STEP 109, whether the setting is required to be recorded or not, and the setting may be recorded when it is determined that the content is required to be recorded.

Though, when the setting is changed, it has been determined at STEP 109 in the embodiment whether the changed content is required to be recorded or not, the invention is not limited to the above embodiment. For example, when the setting is required to be referred to or when referring to the setting is executed, it maybe determined as executed at STEP 109 whether the referred setting is required to be recorded or not, and the referred setting may be recorded when it is determined that the setting is required to be recorded.

In STEP 102 of the embodiment of the present invention, the changing of settings and the inputting of a password are performed on the operation circuit 154 of the printing device 10, however, the present invention is not limited to such a configuration only. For example, inputting may be executed through a personal computer connected to the printing device 10 via the network. Moreover, the information has been configured to be displayed on the display device 152 of the printing device 10 at STEP 114, however, the invention is not limited to the above embodiment. For example, the information may be displayed on a personal computer that is connected to the printing device 10 via the network.

It has been determined in the embodiment, as described in the first embodiment, whether the setting is required to be notified or not and, when it is determined that the setting is required to be notified, processing by which the setting is notified to a terminal for the administrator may be further executed.

Next, the operation of a third embodiment will be explained while referring to FIG. 4. Since the configuration of the third embodiment is similar to those of the first and the second embodiments, explanations of the same will be omitted. Furthermore, with regard to the operation, steps similar to those previously described with reference to the first and the second embodiments are denoted by the same reference numbers as those in FIGS. 2 and 3, and explanations regarding the same will be omitted.

Figure 4:
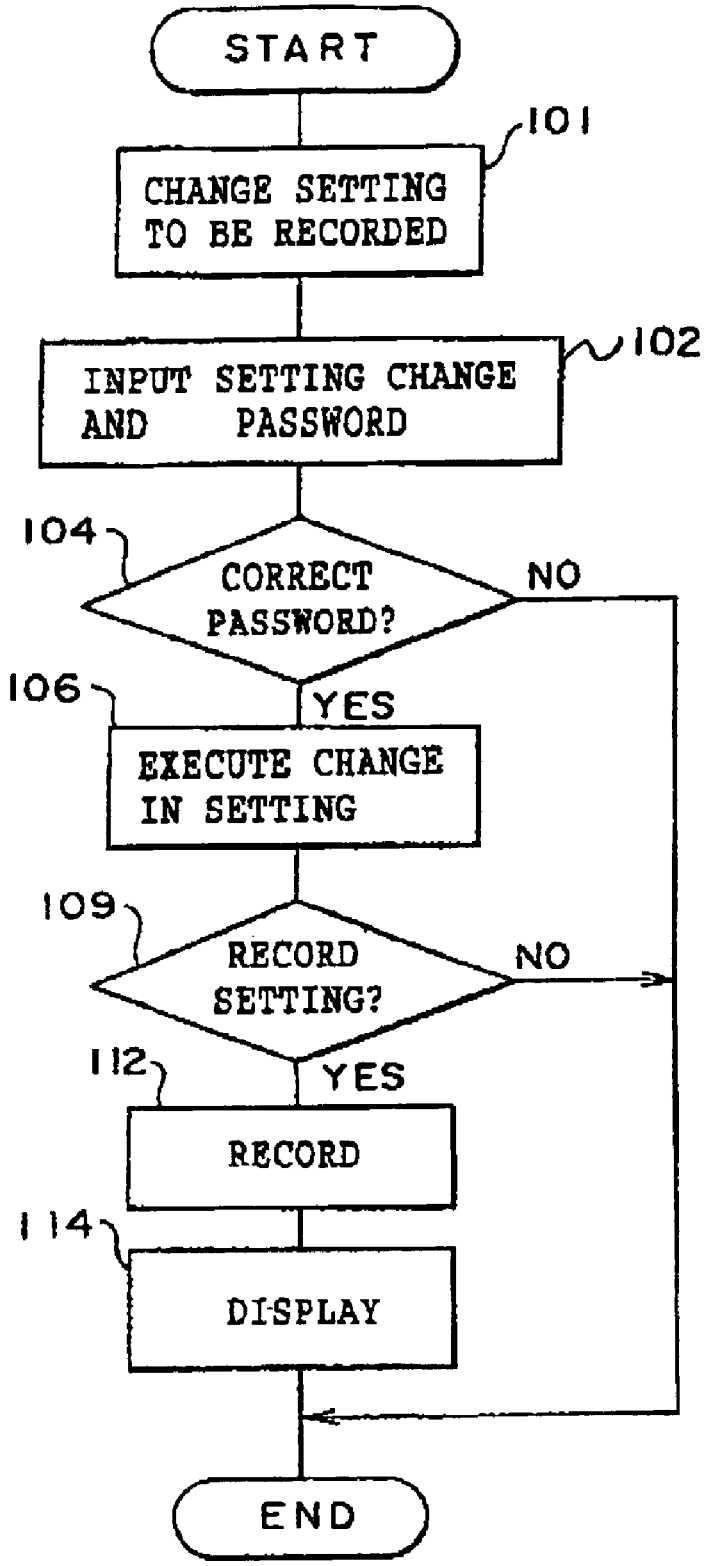
FIG. 4 is a flow chart showing the operation of a third embodiment of the invention.

The user operates an operation circuit 154 in the printing device 10 and a setting on a change setting screen to be recorded is displayed on a display device 152 in order to start the processing in FIG. 4. At STEP 101, the user inputs the setting changes that should be recorded in the printing device 10 according to an instruction on the change setting screen, by operating the operation circuit 154. The inputted setting changes, which are to be recorded, are recorded in a storage device 158.

It is determined at STEP 109, based on the settings, which are required to be recorded and have been changed and recorded in the storage device 158, whether the changed setting is required to be recorded in the storage device 158.

That is, an administrator can change a setting in the printing device 10, which the administrator can easily find to be changed, because the printing device 10 is configured to change a setting to be recorded.

Accordingly, the user including the administrator can find only information on access to a desired setting among pieces of information on respective access which has been given to settings in the printing device 10, referring to the information on the settings which have been recorded in the printing device 10. This reduces the time and energy a user must spend looking for setting information, and furthermore, it conserves the recording capacity of the storage device 158.

Furthermore, when a setting is changed, it has been determined at STEP 109 in the embodiment whether the changed setting is required to be recorded or not. But the invention is not limited to the above embodiment. For example, at STEP 102 at which requirement for change of the setting is input, that is, at which the setting is required to be changed, it may be determined at STEP 109 whether the setting is required to be recorded or not, and the setting may be recorded when it is determined that the content is required to be recorded.

Though, when a setting is changed, it has been determined at STEP 109 in the embodiment whether the changed content is required to be recorded or not, the invention is not limited to the above embodiment. For example, when referring to the setting is required, or when referring to the setting is executed, it may be determined at STEP 109 whether the referred setting is required to be recorded or not, and the referred setting may be recorded when it is determined that the setting is required to be recorded.

Though input of requirement for change of a setting and a password at STEP 102, and change, at STEP 101, of the setting to be recorded are executed through the operation circuit 154 of the printing device 10 in the embodiment, the invention is not limited to the above embodiment. For example, the input and the change may be executed through a personal computer connected to the printing device 10 through a network. Moreover, the information has been configured to be displayed on the display device 152 of the printing device 10 at STEP 114. But the invention is not limited to the above embodiment, and, for example, the information may be displayed on a personal computer connected to the printing device 10 through the network.

It may be determined in the third embodiment, as described in the first embodiment, whether a setting is required to be notified or not and, when it is determined that the setting is required to be notified, processing by which the setting is notified to the terminal for the administrator may be further executed. In such a case, the setting to be notified may be configured to be changed. Moreover, the change and the recording of the setting have been explained for simplified explanation as one series of processing associated with change processing of settings to be recorded. But the invention is not limited to the above embodiments.

What is claimed is:

1. A printing device connected to a network, the printing device comprising:

an inputting component which allows a user to manually input access requirements to setting information set in the printing device, the inputting component including a key pad on the printing device;

a determination component, which determines whether the access requirement information is predetermined information;

an information changing component which changes the predetermined information; and a notification component, which sends notification of the inputted access requirement information to a predetermined administrator's terminal that has been predetermined in the printing device.

2. The printing device of claim 1, further comprising an access component for accessing setting information based on the access requirement information, wherein the notification component notifies the administrator terminal of the access information for the setting information when the setting information is accessed by the access component.

3. The printing device of claim 1, wherein the notification component sends notification of the access requirement information, which is determined to be the access requirement information by the determination component.

4. The printing device of claim 1, wherein the notification component is an e-mail message.

5. The printing device of claim 1, wherein the notification component is an MIB (Management Information Base).

6. The printing device of claim 1, wherein the setting information is at least one of a network setting and a printing conditions setting.

7. The printing device of claim 1, wherein the access to the setting information is for at least one of changing the setting information and referring to the setting information.

8. A printing device connected to a network, the printing device comprising:

an inputting component which allows a user to manually input access requirements to setting information set in the printing device, the inputting component including a key pad on the printing device;

a determination component, which determines whether the access requirement information is predetermined information, an information changing component, which changes the predetermined information; and a recording component for recording access requirement information.

9. The printing device of claim 8, further comprising an access component for accessing the setting information, based on the access requirement information, wherein the recording component records access information for the setting information when the setting information is accessed by the access component.

10. The printing device of claim 8, wherein the recording component records the access requirement information determined to be the predetermined information by the determination component.

11. The printing device of claim 8, further comprising a display component for displaying the access requirement information recorded on the recording component is displayed.

12. The printing device of claim 8, further comprising a notification component, which sends notification of the access requirement information recorded in the recording component to a predetermined administrator's terminal that has been predetermined in the printing device.

13. The printing device of claim 8, wherein the setting information is at least one of a network setting and a printing conditions setting.

14. The printing device of claim 8, wherein the access to the setting information is for at least one of changing the setting information and referring to the setting information.

15. A method of sending notification of access requirement information for a printing device connected to a network, the method comprising the steps of:

manually inputting into a key pad on the printing device access requirements to setting information set in the printing device;

determining whether the access requirement information is predetermined information;

changing the predetermined information; and notifying a predetermined administrator terminal predetermined in the printing device of the inputted access requirement information.

16. The method of claim 15, further comprising a step of accessing the setting information, based on the access requirement information, wherein in the notifying step, notification of the access information for the setting information is sent to the administrator terminal when the setting information is accessed in the accessing step.

17. A recording method for recording access requirement information for a printing device connected to a network, the method comprising the steps of:

manually inputting into a key pad on the printing device access requirements to setting information set in the printing device;

determining whether the access requirement information is predetermined information;

changing the predetermined information; and recording the inputted access requirement information.

18. The method of claim 17, further comprising a step of accessing the setting information, based on the access requirement information, wherein in the recording step, access information for the setting information is recorded when the setting information is accessed in the accessing step.

* * * * *